US010177538B2

(12) United States Patent
Senftleben et al.

(10) Patent No.: US 10,177,538 B2
(45) Date of Patent: Jan. 8, 2019

(54) IGNITION UNIT FOR AN INTERNAL COMBUSTION ENGINE

(71) Applicant: Robert Bosch GmbH, Stuttgart (DE)

(72) Inventors: Hartwig Senftleben, Oberstdorf-Tiefenbach (DE); Manfred Vogel, Ditzingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 490 days.

(21) Appl. No.: 14/889,570

(22) PCT Filed: May 8, 2014

(86) PCT No.: PCT/EP2014/059402
§ 371 (c)(1),
(2) Date: Nov. 6, 2015

(87) PCT Pub. No.: WO2014/180937
PCT Pub. Date: Nov. 13, 2014

(65) Prior Publication Data

US 2016/0087412 A1 Mar. 24, 2016

(30) Foreign Application Priority Data

May 8, 2013 (DE) ..... 10 2013 208 547
May 7, 2014 (DE) ..... 10 2014 208 501

(51) Int. Cl.
*H01T 13/02* (2006.01)
*H01T 13/46* (2006.01)
(Continued)

(52) U.S. Cl.
CPC ..... *H01T 13/462* (2013.01); *F02P 15/08* (2013.01); *H01T 13/24* (2013.01); *H01T 13/42* (2013.01)

(58) Field of Classification Search
USPC ..... 361/247
See application file for complete search history.

(56) References Cited

U.S. PATENT DOCUMENTS

| | | | | |
|---|---|---|---|---|
| 647,946 | A | 4/1900 | Cotton | |
| 1,096,459 | A | 5/1914 | Reisbach | |
| 2016/0087412 | A1* | 3/2016 | Senftleben | H01T 13/42 123/638 |

FOREIGN PATENT DOCUMENTS

| | | |
|---|---|---|
| CN | 2168964 Y | 6/1994 |
| CN | 1222956 A | 7/1999 |

(Continued)

*Primary Examiner* — Ronald W Leja
(74) *Attorney, Agent, or Firm* — Norton Rose Fulbright US LLP; Gerard Messina

(57) ABSTRACT

An ignition device for a combustion chamber of an internal combustion engine includes a first electrode and a second electrode, which is movable with the aid of an actuator. The ignition device is configured to generate a first ignition spark when a contact between the first and second electrode is interrupted. To accomplish this, the second electrode is moved away from the first electrode. A third electrode is also provided, which is spaced apart from the first electrode. With the aid of the third electrode, a second ignition spark can be generated by moving the second electrode away from the other two electrodes. With the three electrodes, the ignition unit is configured to allow the two ignition sparks to pass through a volume formed between the electrodes in the direction transverse to the longitudinal extension of the ignition sparks in the course of the movement of the second electrode.

12 Claims, 10 Drawing Sheets

(51) Int. Cl.

| | |
|---|---|
| ***H01T 13/42*** | (2006.01) |
| ***F02P 15/08*** | (2006.01) |
| ***H01T 13/24*** | (2006.01) |

(56) References Cited

FOREIGN PATENT DOCUMENTS

| | | |
|---|---|---|
| CN | 1294430 A | 5/2001 |
| DE | 26 35 150 | 2/1977 |
| GB | 1909 00 868 | 5/1914 |

* cited by examiner

IGNITION UNIT FOR AN INTERNAL COMBUSTION ENGINE

FIELD OF THE INVENTION

The present invention relates to an ignition unit for an internal combustion engine. In particular, the present invention relates to an improved electrode system to be arranged within a combustion chamber of an internal combustion engine.

BACKGROUND INFORMATION

Ignition units for spark-ignition internal combustion engines are known from the related art. Electrical energy, which is often temporarily stored with the aid of an inductor, flashes through the combustion chamber volume between two electrodes, whereby the ignitable mixture in the combustion chamber is ignited. The two electrodes are usually fixedly situated relative to one another. A spark gap between the electrodes, which is also fixed, is therefore predefined. In order to enable the mixture to be successfully ignited, an at least partially ignitable mixture must be present in the area of the ignition spark gap, the location of which varies only in a stochastically distributed way. The tendency to use lean mixtures, in particular in the partial load range of the internal combustion engine, places increased requirements on the mixture stratification in the area of the ignition spark gap.

Patent document DE 26 35 150 shows the principle of a contact-breaking spark in an inductive circuit of an ignition unit for an internal combustion engine. Therein, a contact separation is mechanically controlled by a piston movement.

U.S. Pat. No. 4,757,788 discusses a contact separation carried out with the aid of a separate relay instead of the piston movement.

It is also believed to be understood to provide multiple ignition spark gaps within a combustion chamber and/or to repeatedly ignite one and the same spark gap in order to increase the probability of a successful ignition. This increases the demand for material and electrical energy for the ignition process, however.

SUMMARY OF THE INVENTION

The aforementioned disadvantages of the related art are resolved, according to the present invention, by an ignition unit for an internal combustion engine. The ignition unit includes a first electrode and a second electrode, the ignition unit being configured to provide a first ignition spark between the first electrode and the second electrode. For this purpose, the first electrode and the second electrode are configured to be placed within a combustion chamber of an internal combustion engine. The ignition unit may optionally include further elements for generating a first ignition spark, as are known from the related art (e.g., in the form of an inductor and/or a transformer). The second electrode is movably situated relative to the first electrode. In other words, the second electrode may be shifted, rotated, or pivoted relative to the ignition unit and the first electrode. This may be carried out, for example, with the aid of an actuator (or "motor"), which is an optional component of the ignition unit and moves the second electrode according to the electromagnetic principle (as is known, e.g., from electrodynamic loudspeakers) and/or via a piezoceramic. According to the present invention, the ignition unit is configured to pass through a predefined area of the combustion chamber with the first ignition spark in the course of a movement of the second electrode.

In other words, the first electrode and the second electrode are configured to move the ignition spark with respect to its longitudinal-extension direction using a transverse component. In addition, the ignition unit includes a third electrode, the third electrode and the second electrode being configured to provide a second ignition spark. In other words, an ignition spark, which may exist in addition to and, in particular, simultaneously with the first ignition spark, may also be generated between the third electrode and the second electrode. The statements made in association with the first electrode may apply similarly for the third electrode. In this way, the area potentially passed through by the ignition spark is enlarged without the need to excessively increase the ignition voltage required to generate the ignition spark. According to the present invention, the second electrode may be shifted relative to the first and/or the third electrode in such a way that the spark gap is shifted or pivoted through a predefined area.

In other words, the sum of the ignition spark gaps describes an area within the combustion chamber, which is predefined by the movement of the electrode or the electrodes. According to the present invention, the second electrode is configured to contact the first electrode and the third electrode at the beginning of a movement. In other words, an electrically conductive connection within the combustion chamber is established between the second electrode and the first electrode and/or the third electrode, which makes it possible to generate an ignition spark as a contact-breaking spark by moving the second electrode away from the first electrode and/or the third electrode. In this way, the ignition voltage and the amount of energy required to generate the ignition spark are reduced and insulation measures may be less complex.

In addition, an electromagnetic and/or an electromechanical actuator is/are provided and is/are configured to move the second electrode. In other words, the actuator may use an electromechanical and/or electromagnetic active principle to move the second electrode. As an alternative or in addition thereto, a piezoceramic may also be used. A control unit may be provided in order to supply the actuator with electrical energy according to a time sequence adapted to the ignition point. This control may be performed by an engine control unit, for example, which controls the internal combustion engine.

The further descriptions herein show further refinements of the present invention.

Further, the three electrodes may be situated in such a way that, before the movable second electrode moves, it contacts the first electrode and, additionally, the third electrode at a contact point in each case. In other words, the second electrode is in contact with both the first and the third electrode before the second electrode moves. This offers the advantage that both the first and the third electrode simultaneously form ignition sparks, so that the ignition voltage may be minimized to the greatest extent possible when a maximum area passed through by both ignition sparks is reached.

Advantageously, the first electrode and the third electrode have a common narrow point at which the minimum distance between the two electrodes is situated. Such a narrow point provides a predefined position for forming a common ignition spark. Material parameters at the narrow point may be selected in such a way that a particularly high resistance to spark erosion exists. In addition, it is possible to allow a spark situated at another spark gap to automatically migrate in the direction of the common narrow point, which is possible, for example, when the distance decreases linearly along the electrodes. In this way, an ignition spark between the first and the third electrode may migrate through the combustion chamber, satisfying the minimum energy principle, without the need to move one of the electrodes any further for this purpose. In this way, the spark erosion is reduced and ignition is made possible at different points within the combustion chamber.

The second electrode may be configured so that it has a convex surface in the direction of the contact points with the first electrode and the third electrode. In other words, a point closest to the first electrode and the third electrode protrudes beyond adjacent points on the surface of the second electrode. Such a surface geometry makes it possible for an ignition foot point situated on the second electrode to migrate in a targeted manner even during a linear movement of the second electrode. In this way, a linear actuator may be used, the mechanics of which may be configured to be robust.

Further, the electrodes may be configured so that the ignition sparks at their two ends each have a spark foot point, which moves on the surface of the associated electrode toward a narrow point in the course of the movement of the second electrode. An ignition spark may be formed between two electrodes at a first point in time, for example, the length of which decreases in the course of the movement of the second electrode due to the fact that the spark foot points migrate along the surfaces of the electrodes. The movement of the second electrode may ensure, on the one hand, that an ignition spark actually forms at a position between two electrodes at which the two electrodes do not have a minimum distance from one another. On the other hand, due to the movement of the second electrode, the ignition spark may be situated at a narrow point at a particular point in time, which also migrates along with the spark over the surface of the electrodes. This embodiment also makes it possible to reduce the spark erosion at one and the same point of the combustion chamber for igniting the mixture at different spatial points.

Further, the three electrodes may be configured and set up via the movement of the second electrode to allow the first ignition spark and the second ignition spark to fuse near the narrow point in the course of the movement of the second electrode. In other words, the first, the second, and the third electrode are advantageously situated relative to one another and the second electrode is additionally shifted in such a way that two spark foot points, for example, of two different ignition sparks approach one another on the surface of one of the electrodes (for example, the second electrode) and subsequently fuse with one another. As a result of such a situation, the newly generated ignition spark no longer satisfies the minimum energy principle, since it does not have a direct connection between the starting point of the first ignition spark and the end point of the second ignition spark (as viewed in the flow direction). Therefore, the common (fused) ignition spark foot point becomes detached and passes through the combustion chamber in the direction of a linear connection between the first spark foot point and the second spark foot point of the newly formed, common ignition spark. This scenario also increases the number of locations and the volume in which an ignition is possible.

For example, the first electrode may be electrically connected to a negative pole and the third electrode may be electrically connected to a ground of a voltage source.

The second (movable) electrode may have an electric potential situated between the negative pole and the electrical ground, which approximately halves the voltage between the negative pole and the electrical ground. This provides for a particularly simple fusion of two ignition sparks, as has been described above. In particular, an inductor may be provided between the negative pole and the first electrode, which is configured to form a magnetic field, with the aid of which the required spark energy may be temporarily stored. The above-described system of electric potentials may be reversed without any functional limitations, of course, so that the first electrode is electrically connected to a positive pole of a voltage source and the third electrode is electrically connected to the electrical ground (or to another corresponding electric potential).

The second electrode may be cylindrical or die-shaped. Die-shaped is understood to mean, for example, a cross-sectional area in which a comparatively narrow shaft transitions into a wider, primarily convex end area. Such a die shape offers a large number of possible spark gaps with adjacent electrodes, which may have narrow points in connection with the convex end area.

In addition, the second electrode may have a planar, pointed, conical or curved end face, which faces the other two electrodes. As an alternative or in addition thereto, the first electrode and the third electrode may be cylindrical, rectangular, L-shaped, or curved. Depending on the relative direction of movement, the aforementioned embodiments of the electrode surfaces represent suitable possibilities for allowing spark gaps to migrate through the combustion chamber in the course of a movement of the second electrode and for achieving reliable ignition and avoiding spark erosion.

The first and the third electrode may be situated on a lateral surface of a virtual hollow cone, the second electrode being situated, at least in sections, within the virtual hollow cone. This makes it possible to avoid direct and undesirable ignition spark gaps between the first and the third electrode before the second electrode has left a predefined position between the first and the third electrode.

The ignition unit may be configured to allow a spark foot point at the first and/or the second electrode to migrate a predefined distance along a surface of the first electrode and/or the second electrode in the course of a movement of the second electrode. In other words, the movement of the second electrode also results in at least one spark foot point completing a predefined path on the surface of the first and/or the second electrode during the existence of the ignition spark. The same may apply for the second electrode and the third electrode. In this way, the erosion of the electrode surface is reduced or is distributed over a larger area, whereby damage which is relevant to the service life of the ignition unit may be avoided or postponed.

Further, the surfaces of the first and the second electrode may be configured relative to one another in such a way that different surface point pairs have a smallest possible distance from one another in the course of a movement of the second electrode. In other words, the position of two mutually associated surface points, which define a smallest possible distance between the electrodes at least with respect to a predefined section, is dependent on the present position of the second electrode. This may be implemented with the aid of a suitable selection of the electrode geometry and/or with the aid of the trajectory executed by the second electrode. The same may apply for the second electrode and the third electrode. Since an ignition spark has the tendency to need to pass through what may be a short spark gap, it is possible—as described above—to force the first ignition spark to pass through the combustion chamber and, on the other hand, to force the spark foot point to migrate on the surfaces of the electrodes. The probability of a successful ignition increases and erosion may be thwarted.

The space situated between the first electrode and the third electrode may be open, over a large area, toward the combustion chamber. In other words, a space situated between the electrodes has a relatively small volume compared to its coupling surface in the direction of the combustion chamber. This may be achieved, for example, with the aid of compact (e.g., cylindrical) designs of the individual electrodes. In this way, it is ensured that a large amount of gas mixture may flow around the electrodes, on the one hand, and, on the other hand, the mechanical stress on the electrodes caused by expansions of the space formed between them in the course of the ignition process is largely prevented. Depending on the embodiment of the actuator, the combustion heat may result in damage or functional impairments. Therefore, it is advantageous to provide a housing surrounding the actuator to be thermally insulating.

According to a further aspect of the present invention, an internal combustion engine including at least one combustion chamber and at least one ignition device, as has been described in detail above, is provided. According to the present invention, the three electrodes have sections within the combustion chamber, while the actuator of the ignition device is situated outside the combustion chamber. In this way, the actuator may be protected against the thermal, chemical, and mechanical stress within the combustion chamber.

Although only one electrode (the second electrode) has been described as being movable within the scope of the preceding description, it is obvious to those skilled in the art that two or even three electrodes may, of course, be provided to be movable without departing from the scope of the present invention. Several different embodiments, surface geometries, and movement trajectories for the electrodes are possible, which constitute the claimed subject matter.

Exemplary embodiments of the present invention are described in detail in the following with reference to the accompanying drawings.

DETAILED DESCRIPTION

Figure 1:
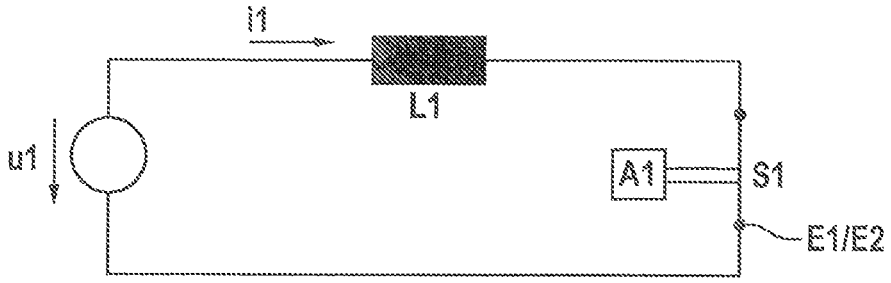
FIG. 1 shows a simplified diagram for explaining the generation of a contact-breaking spark with the aid of a moving electrode when electrodes are in contact with one another.

FIG. 1 shows an electrical energy source u1, which is configured to drive a current i1 with the aid of an inductor L1. For this purpose, a switch S1 downstream from inductor L1 is closed to ground with the aid of an actuator A1. Switch S1 includes a first electrode E1 and a second electrode E2. In FIG. 1, the two electrodes E1, E2 are in electrical contact with one another. Inductor L1 is charged with magnetic energy with the aid of current flow i1.

Figure 2:
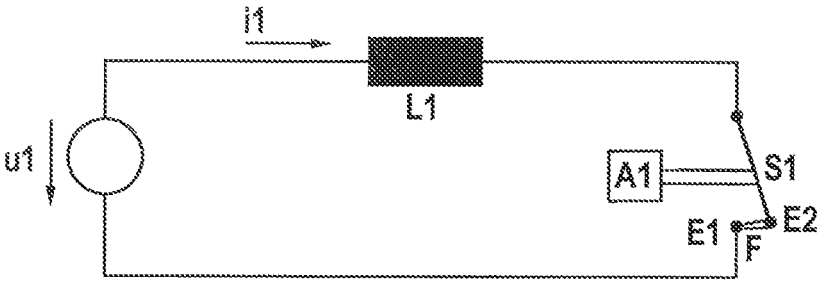
FIG. 2 shows a simplified diagram for explaining the generation of a contact-breaking spark with the aid of a moving electrode when electrodes are separated from one another.

FIG. 2 shows the system represented in FIG. 1 after switch S1 has been opened with the aid of actuator A1. Due to the fact that switch S1 is now open, an ignition spark F has formed between electrodes E1 and E2, which are now spatially separated from one another. Its energy is provided by the magnetic field of inductor L1. If switch S1 or the system of electrodes E1, E2 is situated within a combustion chamber II and ignitable mixture is situated in the area of ignition spark F, the ignition spark may be used to ignite the mixture.

Figure 3:
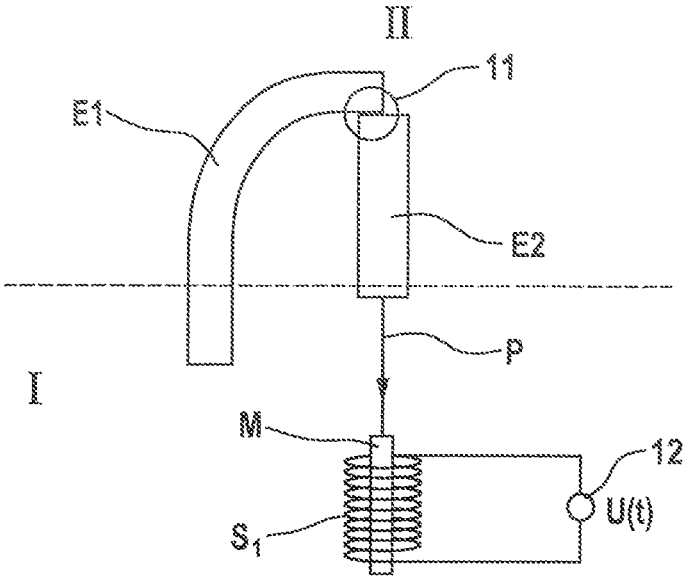
FIG. 3 shows a schematic diagram of a spatial arrangement of a fixed and a movable electrode in a contacted state.

FIG. 3 shows a schematic diagram of one possible spatial embodiment of two electrodes E1, E2. First electrode E1 is curved at least in sections (within combustion chamber II) and is contacted, at a distal end, at a contact point 11 with the aid of a movable second electrode E2. Second electrode E2 is movably mounted in the direction of an arrow P, so that a gap may be established between first electrode E1 and second electrode E2. The system represented in FIG. 3 may be supplied with current, for example, by a system represented in FIGS. 1 and 2. Second electrode E2 is configured as the actuator with the aid of magnetic core M and a coil $S_1$ enclosing magnetic core M, to be shifted in a predefined way via a voltage signal U(t) of a voltage source 12. The actuator is situated outside the combustion chamber, so that it is protected against thermal, chemical, and mechanical influences.

Figure 4:
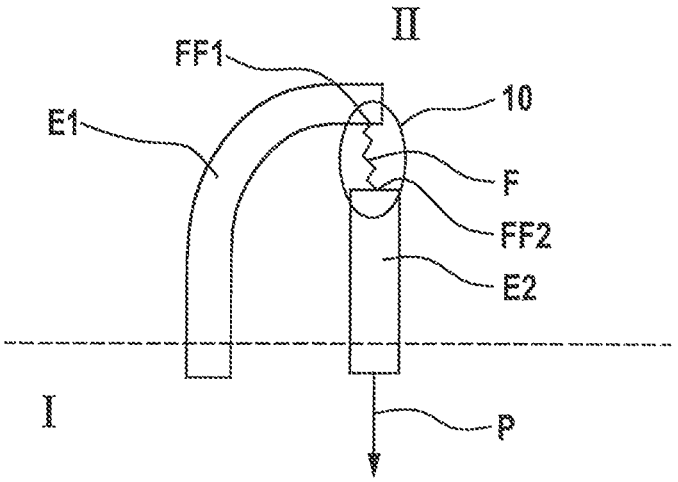
FIG. 4 shows a schematic diagram of a spatial arrangement of a fixed electrode and a movable electrode in a state separated from one another.

FIG. 4 shows the system represented in FIG. 3, after second electrode E2 has been shifted in the direction of arrow P. A narrow point 10, at which electrodes E1, E2 have a minimum distance from one another, has now formed at contact point 11 shown in FIG. 3. The current flow results in an ignition spark F, the length of which increases as the shifting of second electrode E2 increases. Foot points FF1, FF2 of ignition spark F do not migrate along the surfaces of electrodes E1, E2. The required ignition voltage may be reduced in this way, but stationary ignition spark foot point pairs FF1, FF2 result in fixed spark erosion. In addition, the spark gap (apart from its length) is essentially static and is not movable in a predefined manner. For ignition to be successful, it is therefore necessary to bring the ignitable mixture to the very limited spatial area of ignition spark F.

Figure 5A:
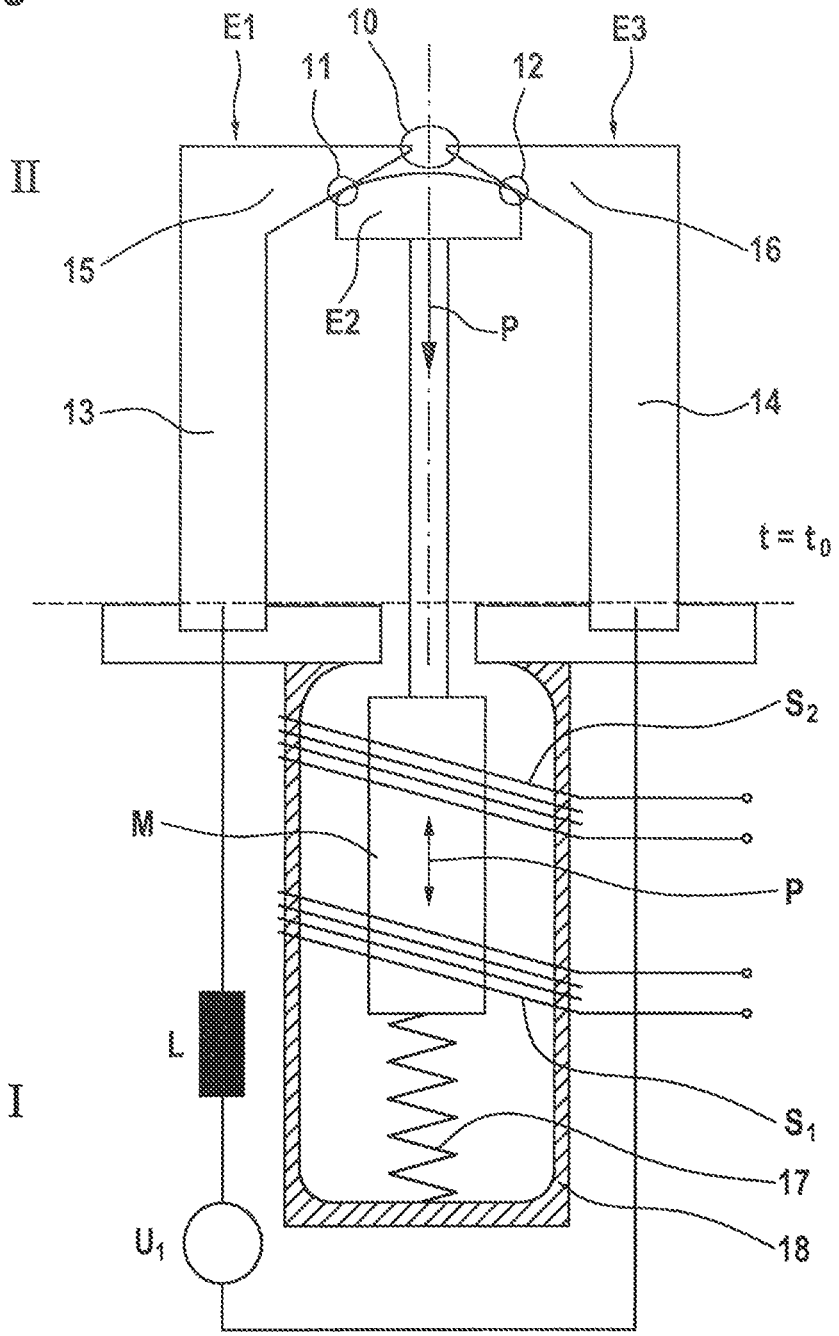
FIGS. 5*a*, 5*b*, 5*c*, 5*d* and 5*e* show a sequence of schematic diagrams, visualizing the fusion of two ignition sparks between three electrodes by moving one electrode.

FIG. 5*a* shows an embodiment of an ignition system of an ignition unit according to the present invention, including a first stationary electrode E1, a second movable electrode E2, and a third stationary electrode E3. First electrode E1 and third electrode E3 include two essentially parallel sections 13, 14, at the outer/distal end of which they approach one another via an essentially gabled structure 15, 16. Second electrode E2 is in electrical contact with the end section 15 of first electrode E1 and the end section 16 of third electrode E3. Second electrode E2 has a convex surface facing end sections 15, 16, which is similar to the upper face of a lens. A (non-depicted) current from the ignition unit flows through the electrical connection between first electrode E1 and second electrode E2 and between second electrode E2 and third electrode E3. The current through first electrode E1 and second electrode E2 is caused by a voltage source $U_1$, an inductor L being provided in series with voltage source $U_1$ and being used as an energy store. If movable electrode E2 in the configuration shown is in contact with first electrode E1 and third electrode E3, a current flows through inductor L, which generates a contact-breaking spark in each case when second electrode E2 is moved away from first and third electrode E1, E3, as will be discussed in conjunction with the following figures. The movement of second electrode E2 is made possible by two coils $S_1$ and $S_2$. Both are situated around a housing 18 outside of combustion chamber II. A magnetic core M is situated within housing 18, which is mechanically, which may be rigidly, coupled to second electrode E2. A current flow through first coil $S_1$ effectuates a movement in a first direction of magnetic core M within the magnetic field permeating coil $S_1$ according to the principle of electrodynamics. This first direction may point, e.g., in the direction of return spring 17, which is compressed in the course of such a movement and generates a restoring force. The same applies for a current flow through second coil $S_2$. This second coil is configured to deploy an action of force as a function of the direction of a current flow, in a way similar to that of return spring 17, the action of force causing second electrode E2 to move in the direction of narrow point 10. An alternative use or control of second coil $S_2$ makes it possible to add the electromagnetic forces of first coil $S_1$ and second coil $S_2$ and, therefore, to achieve a great displacement with a largely linear application of force and, additionally, to use two currents generated independently of one another. A further advantage of the use of a second coil $S_2$ (in addition to or instead of return spring 17) is its centering effect on a magnetic core M. In the example shown, currents i1, i2 are provided by (non-depicted) control units. For example, an engine control unit or a control unit provided for ignition could also be configured to generate the two coil currents i1, i2.

Figure 5B:
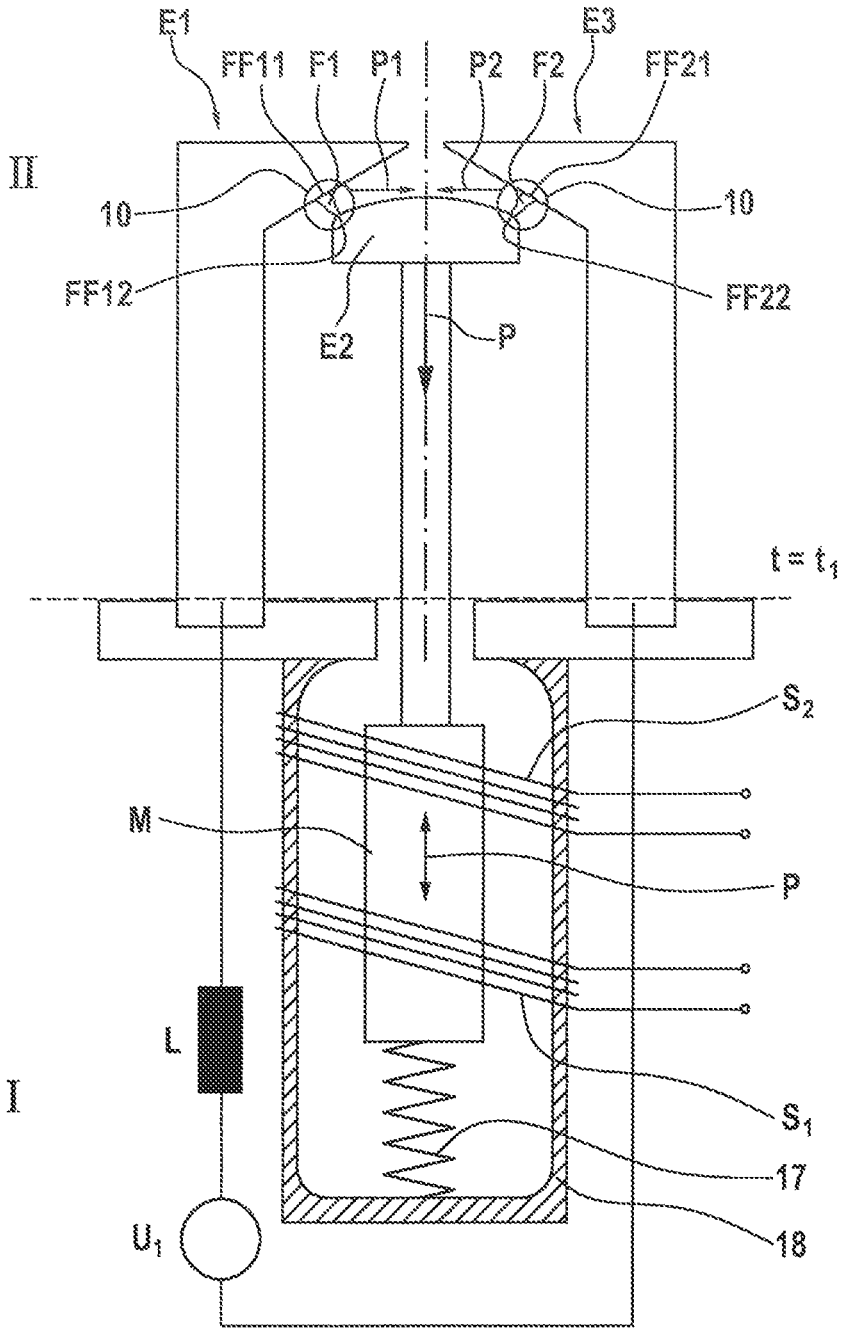

FIG. 5*b* shows the system represented in FIG. 5*a* after second electrode E2 has moved away, in the direction of arrow P, from the gabled structure of the end sections of first electrode E1 and third electrode E3. Due to the fact that second electrode E2 has moved away from first electrode E1, a first ignition spark F1 has formed between the two, in an area having a minimum distance in the form of a narrow point 10 including a first ignition spark foot point FF11 on first electrode E1 and including a second ignition spark foot point FF12 on second electrode E2. This first ignition spark is situated in an area of narrow point 10 between first electrode E1 and second electrode E2. Correspondingly, due to the fact that second electrode E2 has moved away from third electrode E3, a second ignition spark F2 has formed between second electrode E2 and third electrode E3 in an area of narrow point 10 having a third ignition spark foot point FF22 on second electrode E2 and having a fourth ignition spark foot point FF21 on third electrode E3. The system is apparently symmetrically configured.

Figure 5C:
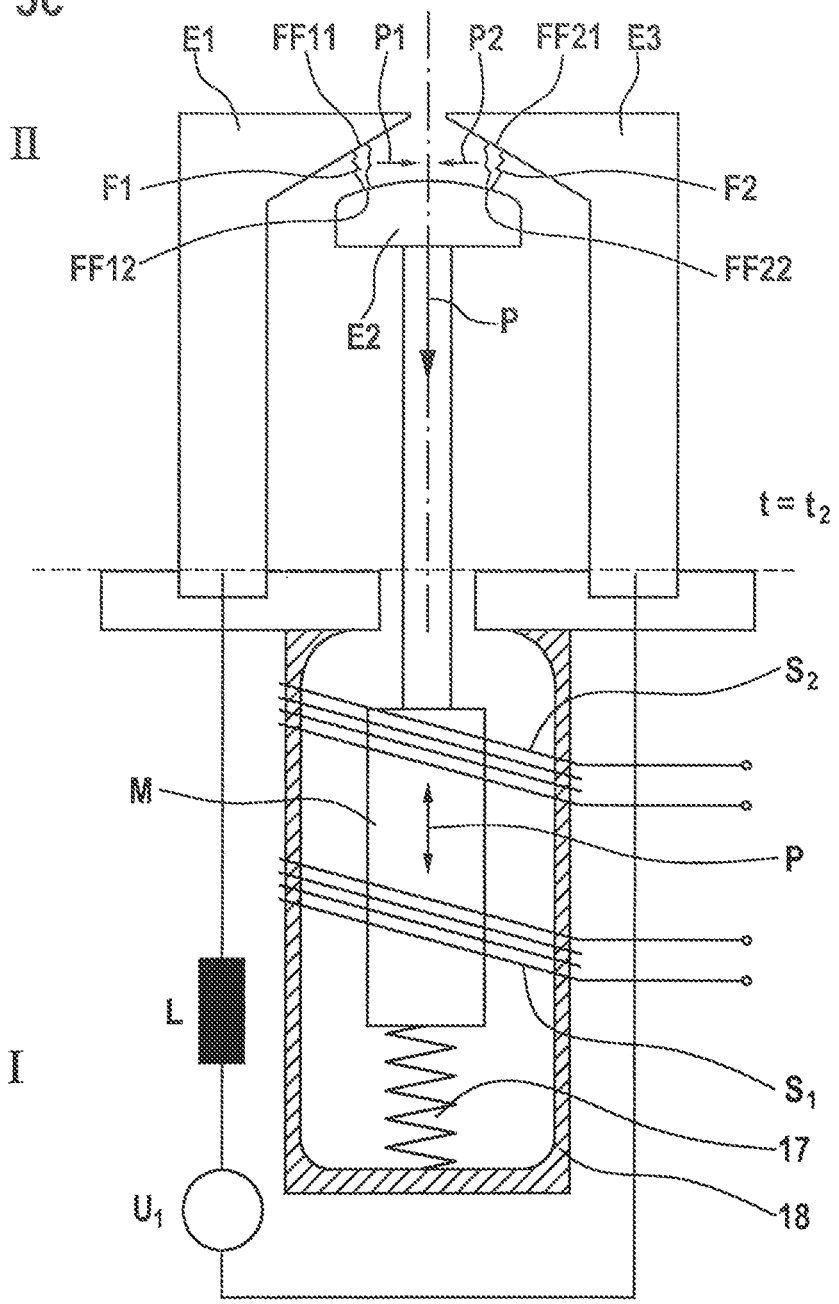

FIG. 5*c* shows the system represented in FIG. 5*b* after second electrode E2 has been moved further away from the end sections of first electrode E1 and third electrode E3 in the direction of arrow P. First ignition spark F1 and second ignition spark F2 have migrated in the direction of the minimum distance between first electrode E1 and third electrode E3, i.e., in the direction of arrows P1 and P2, respectively. The surface geometry of electrodes E1, E2 and E3 is configured in such a way that ignition spark foot points FF11-FF22 have migrated in the direction of arrow P1 and P2 in the course of the movement of second electrode E2. If ignition spark foot points FF12, FF22 situated on second electrode E2 migrate further in the direction of arrows P1, P2, respectively, the foot points of ignition sparks F1, F2 meet on the surface of second electrode E2, whereby sparks F1, F2 fuse.

Figure 5D:
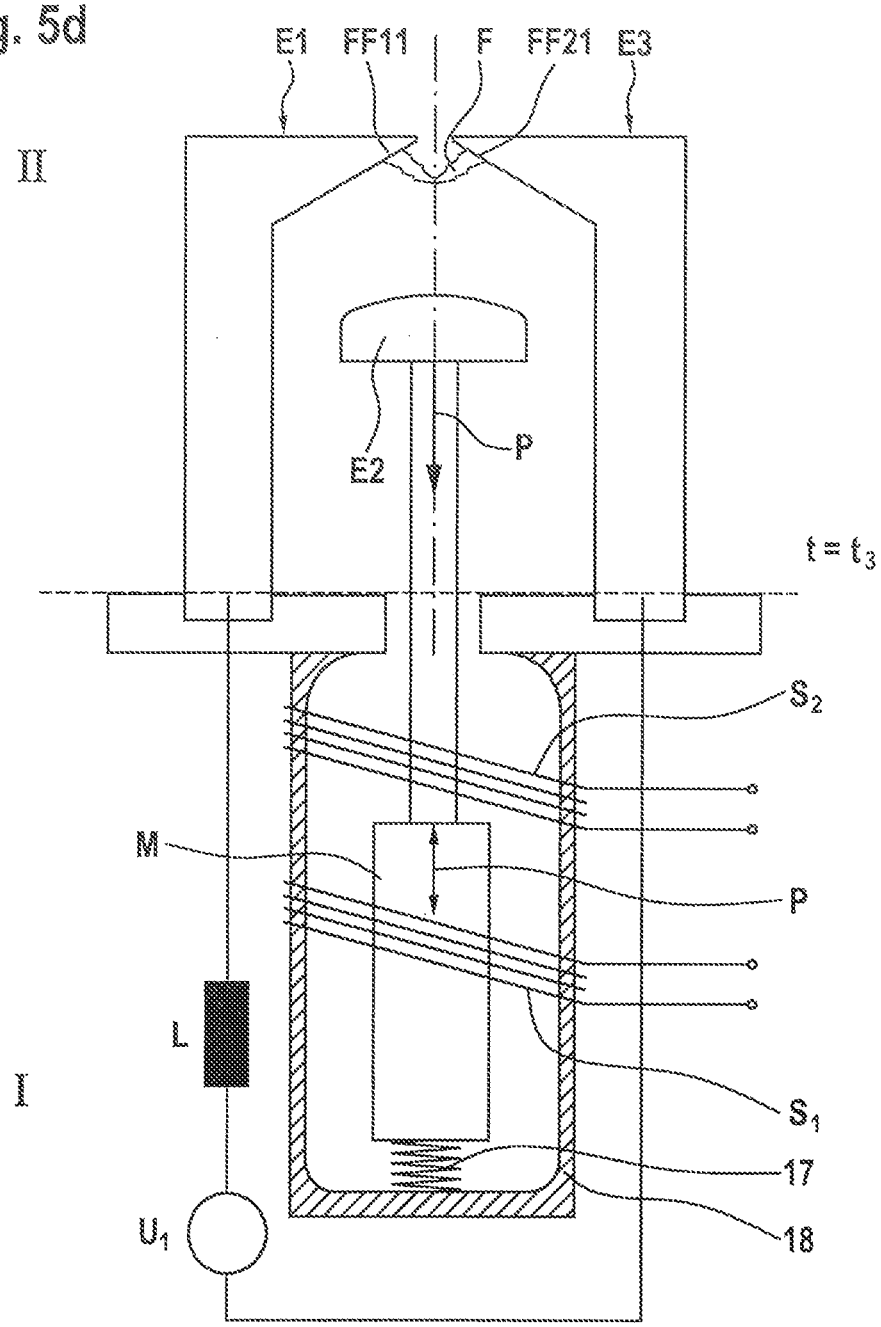

FIG. 5*d* shows the result of the movement of second electrode E2 in the direction of arrow P. Ignition spark foot points FF12, FF22 situated on second electrode E2 have met, in response to which first ignition spark F1 and second ignition spark F2 have fused to form a single ignition spark F. Since ignition spark F, which now extends in a V-shape, attempts to shorten in accordance with the minimum energy principle, the situation shown in FIG. 5*e* sets in.

Figure 5E:
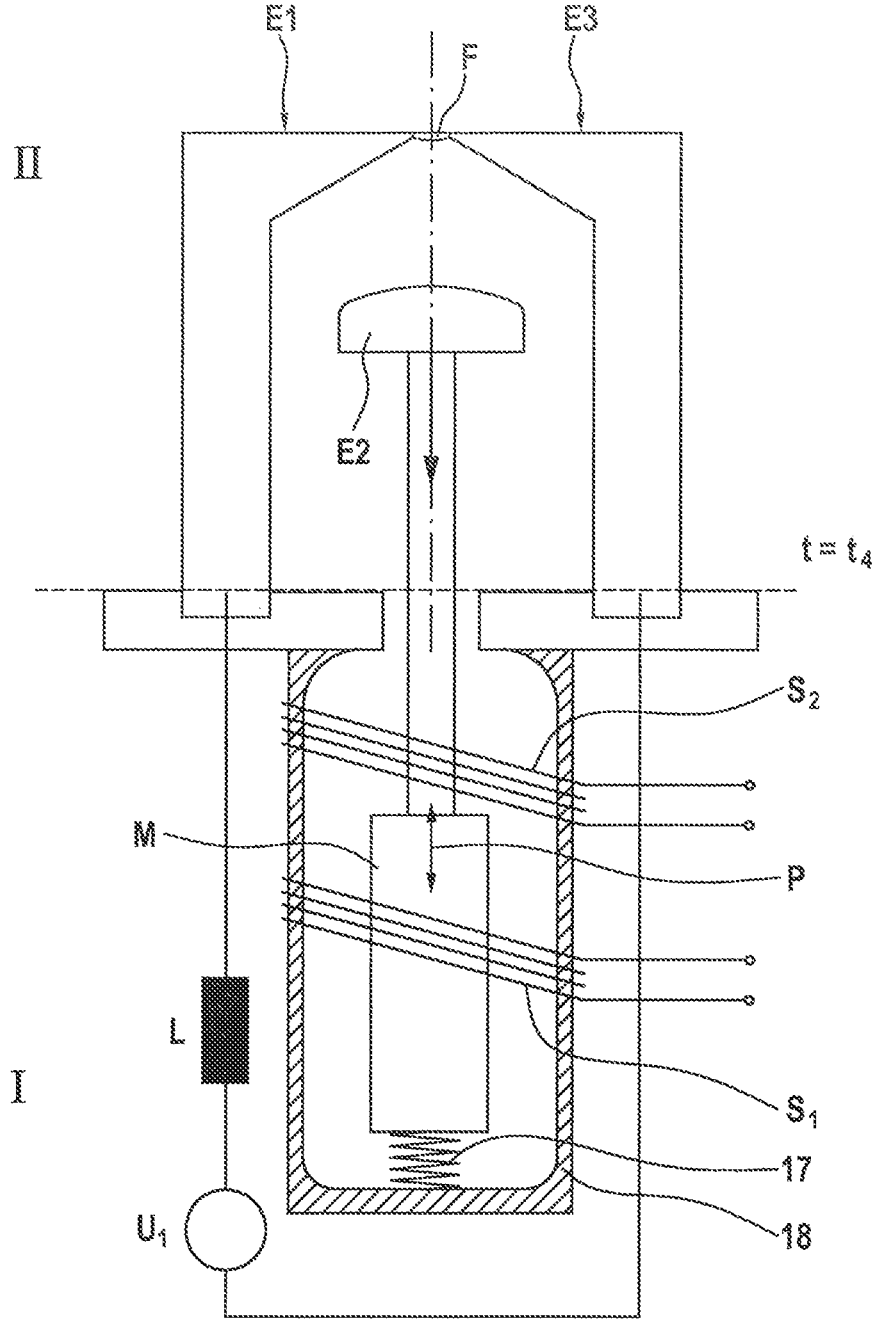

In FIG. 5*e*, the ignition spark, with its foot points, has migrated to the points on first electrode E1 and third electrode E3 having the minimum distance from one another. This spark gap finally satisfies the minimum energy principle for ignition spark F. By viewing FIGS. 5*a* through 5*e* in combination it becomes apparent how much surface area ignition sparks F1, F2 and ignition spark F have passed through due to the movement of second electrode E2. The probability that the ignition spark or ignition sparks will ignite an ignitable mixture is substantially increased as compared to a fixed spark gap according to the teaching of the related art.

Figure 6:
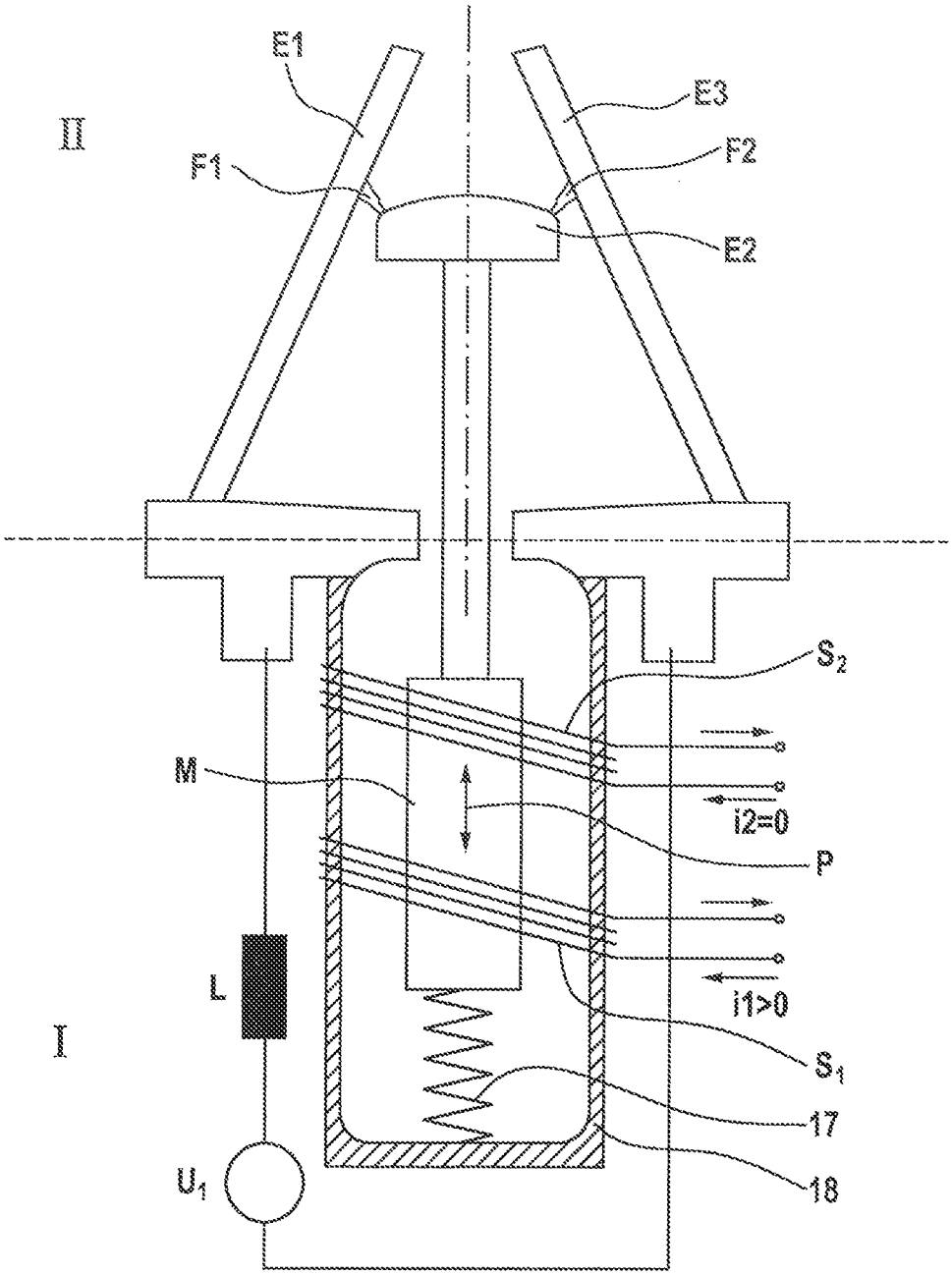
FIG. 6 shows a schematic diagram of an alternative electrode geometry having a linearly converging gap.

FIG. 6 shows an electrode geometry, which is an alternative to the electrode system represented in FIG. 5. The electrode sections of electrodes E1, E3 situated in combustion chamber II are cylindrical or rod-shaped, for example, it being possible for their cross-section to be circular, elliptical, or rectangular. The two linearly approach one another in the direction of the combustion chamber on an imaginary axis through the actuator and in the direction of movement of second electrode E2. The mode of operation of the system is identical to that discussed in conjunction with FIG. 5.

Figure 7:
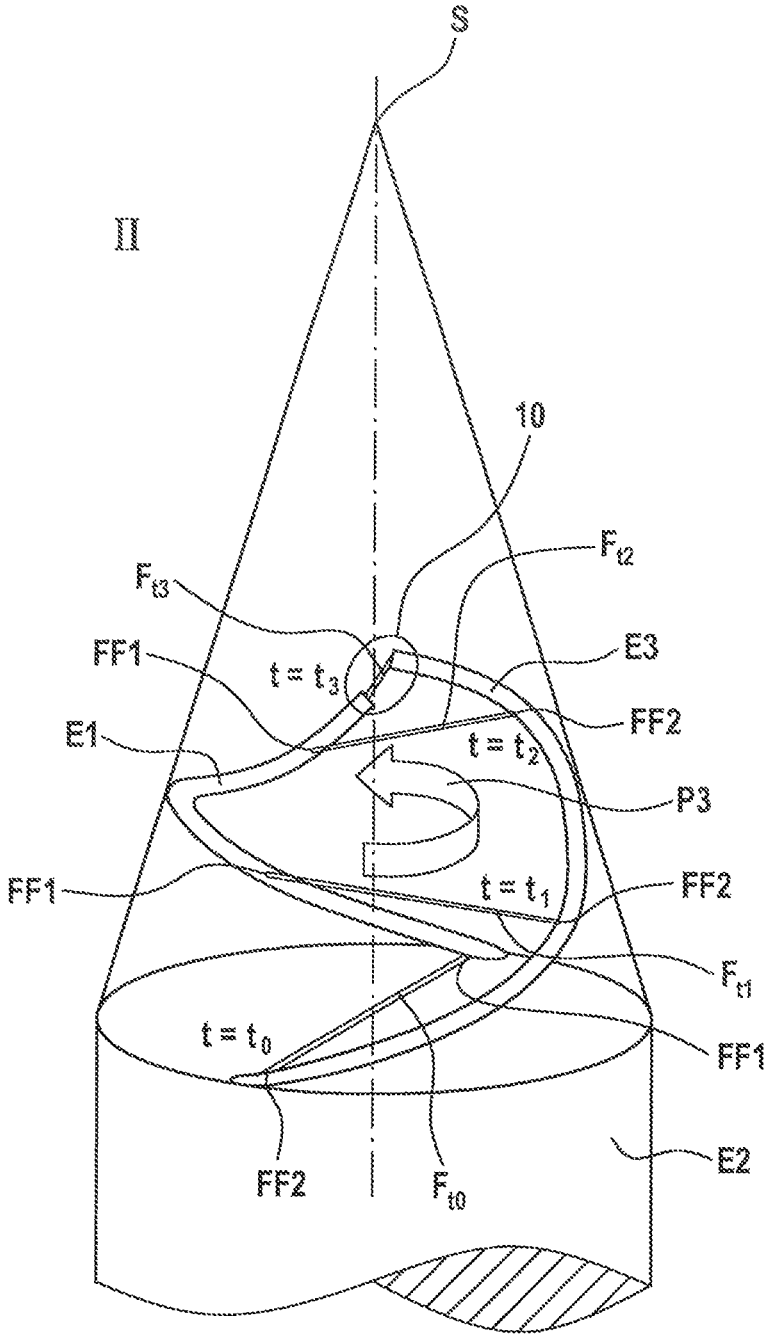
FIG. 7 shows a schematic diagram of an alternative electrode geometry having a gap converging along a conical lateral surface.

FIG. 7 shows an alternative system and embodiment of three electrodes E1, E2, E3. A first electrode E1 and a third electrode E3 are helically situated along a conic (or "conical") enveloping surface. A second electrode E2 is situated underneath the two electrodes E1, E3, which initially contacts the two electrodes E1, E3 in the configuration shown. Although these are diametrically opposed with respect to the axis of the cone, the gap between first electrode E1 and third electrode E3 tapers in the direction of tip S of the cone. At a first point in time $t=t_0$ (as explained in conjunction with FIGS. 5*a* through 5*e*), two contact-breaking sparks are generated, one between first electrode E1 and second electrode E2 and one between second electrode E2 and third electrode E3, and subsequently fuse at the base of the cone as a result of second electrode E2 moving away from first electrode E1 and third electrode E3. This process has already been described in conjunction with FIGS. 5*a* through 5*e*.

After fused ignition spark $F_{t1}$ between first electrode E1 and third electrode E3 has been generated, it attempts to shorten the spark gap to be bridged, in order to satisfy the minimum energy principle. Ignition spark $F_{t1}$ therefore migrates upward in the cone in the direction of tip S, the ignition spark completing one rotation about the axis of rotational symmetry of the cone, as is indicated by arrow P3. At a point in time $t=t_2$, ignition spark $F_{t1}$ has "screwed" its way further up the electrode spiral, so that, as ignition spark $F_{t2}$, it now has a shorter length than before. In order to satisfy the minimum energy principle, ignition spark foot points FF1, FF2 migrate further up electrodes E1, E3 until, at a later point in time $t=t_3$, they form an ignition spark $F_{t3}$, which has arrived at a narrow point 10 between electrodes E1, E3 between two points having a minimum distance.

Figure 8:
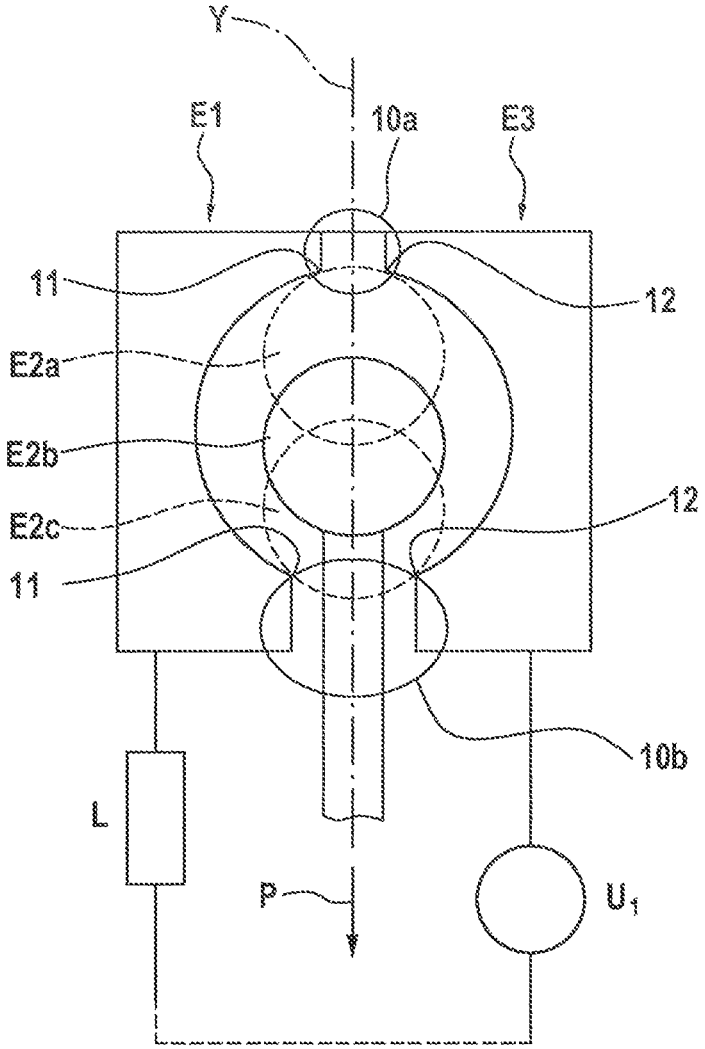
FIG. 8 shows a schematic diagram of an alternative electrode geometry having a gap converging along a hollow-sphere surface.

FIG. 8 shows an alternative system of three combustion chamber electrodes E1, E2, E3. First electrode E1 and third electrode E3 are situated essentially symmetrically with respect to axis of symmetry y and symmetrically with respect to the axis of motion of second electrode E2. First electrode E1 and third electrode E3 have two local narrow points 10*a*, 10*b*, between which the two electrodes E1, E3 have concave sections. In other words, the gap between the electrodes increases so as to form a cavity in an area between local narrow points 10*a*, 10*b*. Within the cavity formed in this way, a movable second electrode E2 is shown in three possible positions a), b), c). Second electrode E2 has an essentially spherical end section, which has a smaller radius than the cavity formed between first electrode E1 and third electrode E3. In this way, it is possible that second electrode E2 in position a) has a contact point 11, 12 with first electrode E1 and third electrode E3, respectively, at its outermost end, whereas (after having moved in the direction of arrow P) it has a contact point 11, 12, respectively, in the direction of its suspension. In a position b) shown, second electrode E2 is situated between positions a) and b), in which it has a narrow point, e.g., with the points of the concave electrode surfaces having a maximum distance from axis of symmetry y. In position a), a contact-breaking spark may be generated between first electrode E1 and second electrode E2 as well as between third electrode E3 and second electrode E2. If second electrode E2 is now moved out of position a) into position b), the narrow points between second electrode E2 and stationary electrodes E1, E3, respectively, migrate along the spherical surface of second electrode E2 as well as along corresponding points on the hollow-sphere shaped surfaces of first electrode E1 and third electrode E3. Second electrode E2 finally reaches its end position c), in which it once more has contact with stationary electrodes E1, E3. A further contact-breaking spark may therefore be generated in this position by reversing the direction of movement of second electrode E2 until finally, in position a), it comes into contact once more with first electrode E1 and third electrode E3. In this way, retracting reciprocating movement of the second electrode (e.g., in two consecutive ignition cycles) may be provided according to the present invention.

A basic concept of the present invention is to dynamically generate an ignition spark of an ignition unit for an internal combustion engine, in a predefined manner, with the aid of a movable arrangement of at least one electrode. At the same time, the spark gap is moved, rotated, pivoted or modified in some other way at a first point in time with respect to a second point in time in order to break through different combustion chamber volumes at different points in time. The probability of successfully igniting an ignitable mixture is increased as a result, so that lean mixtures and less homogeneous mixtures may be used. In addition, electrode erosion may be avoided, since the ignition spark foot point on a particular electrode migrates over time on the surface of the electrode.

Even though the aspects according to the present invention and advantageous specific embodiments have been described in detail with reference to exemplary embodiments illustrated with the aid of the attached figures, those skilled in the art will consider modifications and combinations of features of the exemplary embodiments shown to be possible without departing from the scope of the present invention, the scope of protection of which is defined by the attached claims.

What is claimed is:

1. An ignition device for a combustion chamber of an internal combustion engine, comprising:

an ignition arrangement, including:

a first electrode;

a second electrode, which is movable with the aid of an actuator, wherein the ignition arrangement is configured to generate a first ignition spark when a contact between the first electrode and the second electrode is interrupted by moving the second electrode away from the first electrode; and a third electrode, which is spaced apart from the first electrode, wherein a second ignition spark is additionally generated when the second electrode is moved away from the other two electrodes;

wherein the three electrodes are configured so that the two ignition sparks pass through a volume formed between the electrodes in the direction transverse to the longitudinal extension of the ignition sparks in the course of the movement of the second electrode, wherein the second electrode has a convex surface in a direction of contact points with the first electrode and the third electrode wherein a position of two mutually associated surface points, which define a smallest possible distance between one of the first and third electrodes and the second electrode at least with respect to a predefined section, is dependent on a present position of the second electrode.

2. The ignition device of claim 1, wherein the three electrodes are situated so that, before the movable second electrode moves, it contacts the first electrode and the third electrode at the respective contact point in each case.

3. The ignition device of claim 2, wherein the second electrode, as viewed from the contact points, protrudes with one section in the direction of the first electrode and the third electrode or in the direction of the narrow point.

4. The ignition device of claim 1, wherein the first electrode and the third electrode have a common narrow point at which their minimum distance from one another is situated.

5. The ignition device of claim 1, wherein one of the following is satisfied: (i) the first electrode is electrically connected to a negative pole and the third electrode is connected to an electrical ground or to a corresponding positive pole of a voltage source, an inductor being between the negative pole and the first electrode, and (ii) the first electrode is electrically connected to a positive pole and the third electrode is connected to an electrical ground or to a corresponding negative pole of a voltage source, an inductor being between the positive pole and the first electrode.

6. The ignition device of claim 1, wherein the second electrode is cylindrical or die-shaped and/or has a planar, pointed, conical or curved end face, which faces the other two electrodes, and/or the first electrode and the third electrode are cylindrical, rectangular, L-shaped, or curved.

7. The ignition device of claim 1, wherein the actuator includes at least one electrical coil, which interacts with a magnetic core which is mechanically connected to the second electrode, the actuator also including a return spring, which counteracts a force generated by the coil and the magnetic core.

8. An ignition device for a combustion chamber of an internal combustion engine, comprising:

an ignition arrangement, including:

a first electrode;

a second electrode, which is movable with the aid of an actuator, wherein the ignition arrangement is configured to generate a first ignition spark when a contact between the first electrode and the second electrode is interrupted by moving the second electrode away from the first electrode; and a third electrode, which is spaced apart from the first electrode, wherein a second ignition spark is additionally generated when the second electrode is moved away from the other two electrodes;

wherein the three electrodes are configured so that the two ignition sparks pass through a volume formed between the electrodes in the direction transverse to the longitudinal extension of the ignition sparks in the course of the movement of the second electrode, wherein the ignition sparks each have a spark foot point at both of their ends, the spark foot points moving on the surface of the associated electrode toward a narrow point in the course of the movement of the second electrode.

9. An ignition device for a combustion chamber of an internal combustion engine, comprising:

an ignition arrangement, including:

a first electrode;

a second electrode, which is movable with the aid of an actuator, wherein the ignition arrangement is configured to generate a first ignition spark when a contact between the first electrode and the second electrode is interrupted by moving the second electrode away from the first electrode; and a third electrode, which is spaced apart from the first electrode, wherein a second ignition spark is additionally generated when the second electrode is moved away from the other two electrodes;

wherein the three electrodes are configured so that the two ignition sparks pass through a volume formed between the electrodes in the direction transverse to the longitudinal extension of the ignition sparks in the course of the movement of the second electrode, wherein the electrodes are configured to allow the first ignition spark and the second ignition spark to fuse close to a narrow point in the course of the movement of the second electrode.

10. An ignition device for a combustion chamber of an internal combustion engine, comprising:

an ignition arrangement, including:

a first electrode;

a second electrode, which is movable with the aid of an actuator, wherein the ignition arrangement is configured to generate a first ignition spark when a contact between the first electrode and the second electrode is interrupted by moving the second electrode away from the first electrode; and a third electrode, which is spaced apart from the first electrode, wherein a second ignition spark is additionally generated when the second electrode is moved away from the other two electrodes;

wherein the three electrodes are configured so that the two ignition sparks pass through a volume formed between the electrodes in the direction transverse to the longitudinal extension of the ignition sparks in the course of the movement of the second electrode, wherein the first electrode and the third electrode are situated on a lateral surface of a virtual hollow cone, the second electrode being situated, at least in sections, within the virtual hollow cone.

11. An internal combustion engine, comprising:

at least one combustion chamber; and at least one ignition device for the combustion chamber of an internal combustion engine, including:

a first electrode;

a second electrode, which is movable with the aid of an actuator, wherein the ignition device is configured to generate a first ignition spark when a contact between the first electrode and the second electrode is interrupted by moving the second electrode away from the first electrode; and a third electrode, which is spaced apart from the first electrode, wherein a second ignition spark is additionally generated when the second electrode is moved away from the other two electrodes;

wherein the three electrodes are configured so that the two ignition sparks pass through a volume formed between the electrodes in the direction transverse to the longitudinal extension of the ignition sparks in the course of the movement of the second electrode, and wherein the three electrodes of the ignition device are situated within the combustion chamber and the actuator of the ignition device is situated outside the combustion chamber, wherein the second electrode has a convex surface in a direction of the contact points with the first electrode and the third electrode wherein a position of two mutually associated surface points, which define a smallest possible distance between one of the first and third electrodes and the second electrode at least with respect to a predefined section, is dependent on a present position of the second electrode.

12. An ignition device for a combustion chamber of an internal combustion engine, comprising:

an ignition arrangement, including:

a first electrode;

a second electrode, which is movable with the aid of an actuator, wherein the ignition arrangement is configured to generate a first ignition spark when a contact between the first electrode and the second electrode is interrupted by moving the second electrode away from the first electrode; and a third electrode, which is spaced apart from the first electrode, wherein a second ignition spark is additionally generated when the second electrode is moved away from the other two electrodes;

wherein the three electrodes are configured so that the two ignition sparks pass through a volume formed between the electrodes in the direction transverse to the longitudinal extension of the ignition sparks in the course of the movement of the second electrode, wherein the first electrode and the third electrode have a common narrow point at which their minimum distance from one another is situated, wherein the electrodes are configured to allow the first ignition spark and the second ignition spark to fuse close to the narrow point in the course of the movement of the second electrode.

* * * * *